US007308742B2

(12) United States Patent
Schultz

(10) Patent No.: US 7,308,742 B2
(45) Date of Patent: Dec. 18, 2007

(54) HARDWARE FOR MOUNTING A CASKET HANDLE

(75) Inventor: Craig H. Schultz, York, PA (US)

(73) Assignee: Matthews Resources, Inc., Wilmington, DE (US)

( * ) Notice: Subject to any disclaimer, the term of this patent is extended or adjusted under 35 U.S.C. 154(b) by 0 days.

(21) Appl. No.: 11/536,184

(22) Filed: Sep. 28, 2006

(65) Prior Publication Data

US 2007/0094854 A1 May 3, 2007

Related U.S. Application Data

(60) Provisional application No. 60/722,386, filed on Sep. 30, 2005.

(51) Int. Cl.
*A61G 17/00* (2006.01)

(52) U.S. Cl. ..... 27/27; 16/439

(58) Field of Classification Search ..... 27/27, 27/2, 35; D99/11; 16/424, 439, 425, 438
See application file for complete search history.

(56) References Cited

U.S. PATENT DOCUMENTS 3,204,286 A * 9/1965 Hillenbrand ..... 16/439
4,068,347 A 1/1978 Johnson et al.
4,077,096 A 3/1978 Christian
4,615,085 A 10/1986 Hartman
5,008,990 A 4/1991 Craft
5,309,614 A 5/1994 MacKirdy
5,519,923 A 5/1996 Rojdev et al.
5,522,116 A 6/1996 Enneking et al.
5,689,869 A 11/1997 Linville et al.
5,898,980 A 5/1999 Havranek et al.
5,933,917 A * 8/1999 Lo ..... 16/439
6,154,939 A 12/2000 Woedl
6,499,193 B1 12/2002 Robert

* cited by examiner

*Primary Examiner*—William L. Miller
(74) *Attorney, Agent, or Firm*—Reed Smith LLP

(57) ABSTRACT

A handle hardware assembly for attaching a handle to the sidewall of a casket. The hardware assembly comprises a lifting arm and clevis each having a pair of pivot arms or flanges. Each clevis pivot flange has a protrusion which is engageable with three radially spaced depressions of a corresponding lifting arm pivot arm. The selected depression the protrusion is engaged in determines the fixed position of the handle relative to sidewall of the casket. Also, a bolt is insertable from inside the casket such that the sharp end of the bolt is between the clevis pivot flanges to avoid injury to a funeral director or others.

7 Claims, 5 Drawing Sheets

HARDWARE FOR MOUNTING A CASKET HANDLE

CROSS-REFERENCE TO RELATED APPLICATION

This application claims the benefit under 35 U.S.C. 119(e) of U.S. Provisional Application No. 60/722,386 filed Sep. 30, 2005.

FIELD OF THE INVENTION

The present invention relates to hardware for mounting a handle bar on a casket.

BACKGROUND

Handle bars on a burial casket may be utilized during a burial service by pall bearers to lift and carry the casket. Many caskets are provided with "swing bar type" handle bars so that the bars swing outwardly first. Swing hardware permits the pall bearer to grasp the handle without engaging the casket shell while also permitting the casket to fit into limited space for storage. Typical swing hardware may feel loose and unsteady and may prove to be noisy when the handle bar is pivoted. Also, typical swing hardware is mounted from the outside of the casket with bolts which protrude into the interior of the casket shell. The ends of the bolts may be a safety hazard for a funeral director.

SUMMARY OF THE INVENTION

The handle hardware assembly of the present invention attaches a handle to sidewall of a casket. The hardware assembly of an exemplary embodiment of the present invention comprises a lifting arm and amounting base or clevis each having a pair of pivot arms or flanges. Each clevis and lifting arm pivot arm has corresponding position stops engageable with each other. Specifically, each clevis pivot flange has a protrusion which is engageable with three radially spaced depressions of a corresponding lifting arm pivot arm. The selected depression the protrusion is engaged in determines the fixed position of the handle relative to sidewall of the casket. Also, a low profile bolt is insertable from inside the casket such that the sharp end of the bolt is between clevis pivot arms to avoid injury to a funeral director or others.

BRIEF DESCRIPTION OF THE DRAWINGS

The present invention and its presently preferred embodiments will be better understood by way of reference to the detailed disclosure herebelow and to the accompanying drawings.

DETAILED DESCRIPTION OF THE PREFERRED EMBODIMENTS

Figure 1:
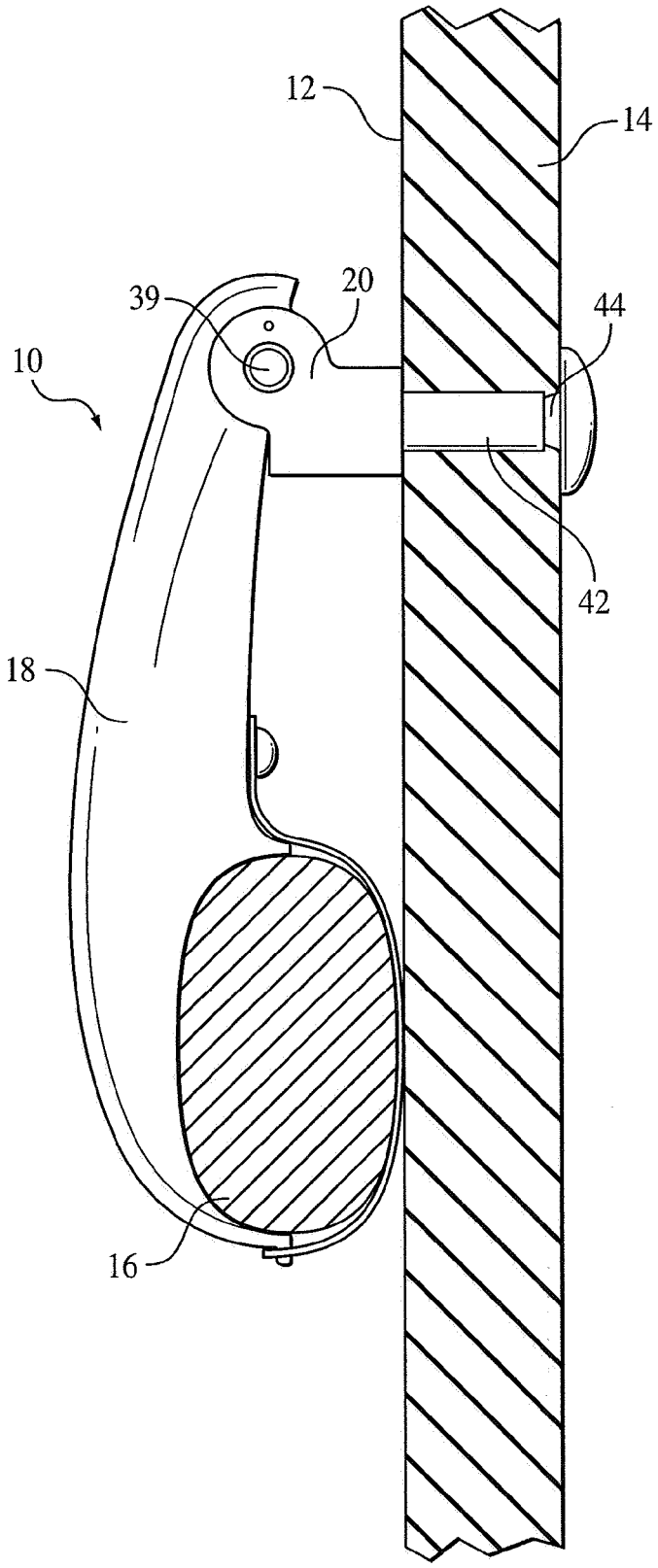
FIG. 1 is a side view of the hardware assembly of the present invention with the handle in the first position mounted to a cut-away casket.
Figure 2:
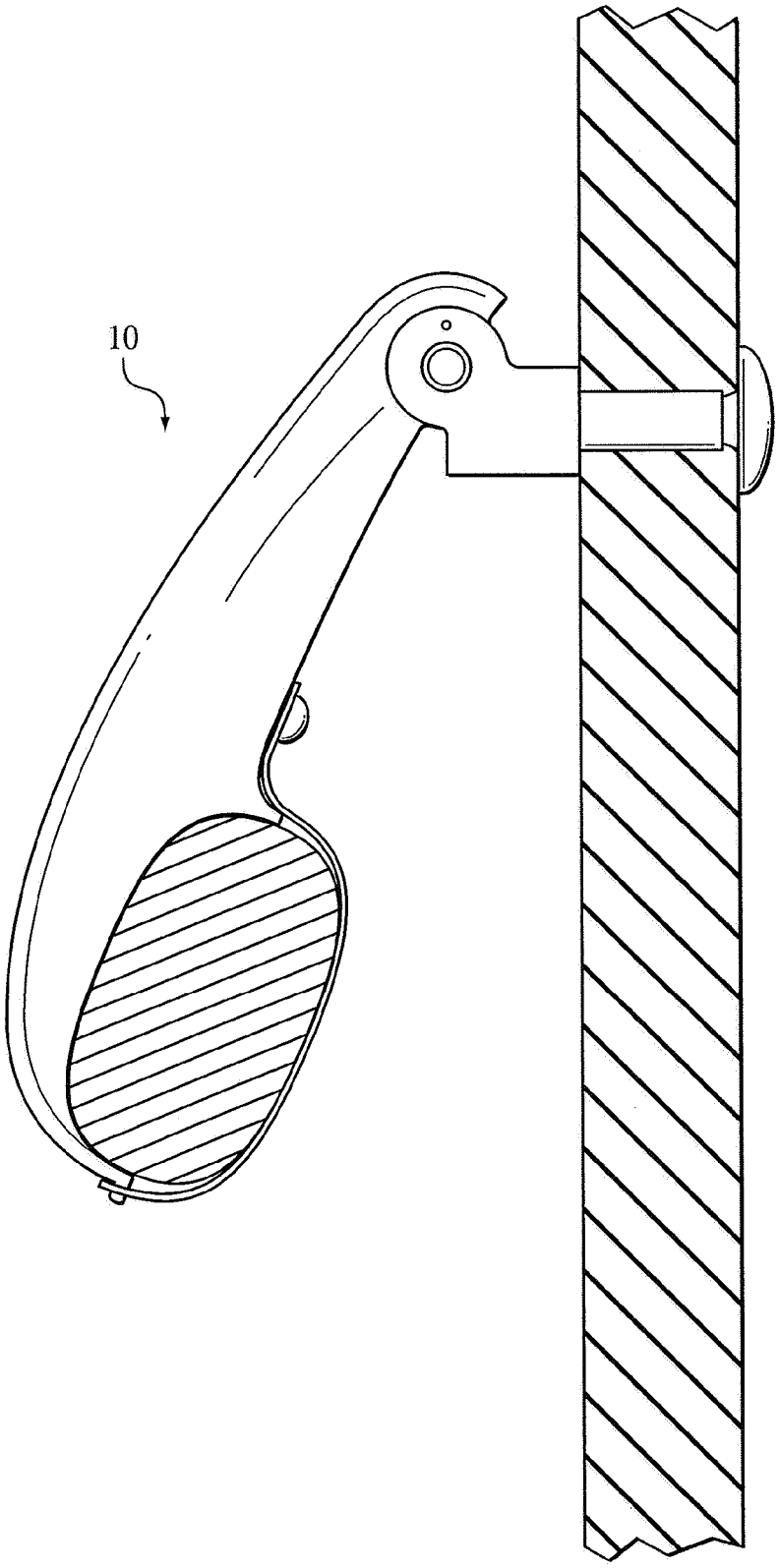
FIG. 2 is a side view of the hardware assembly of the present invention with the handle in the second position mounted to a cut-away casket.
Figure 3:
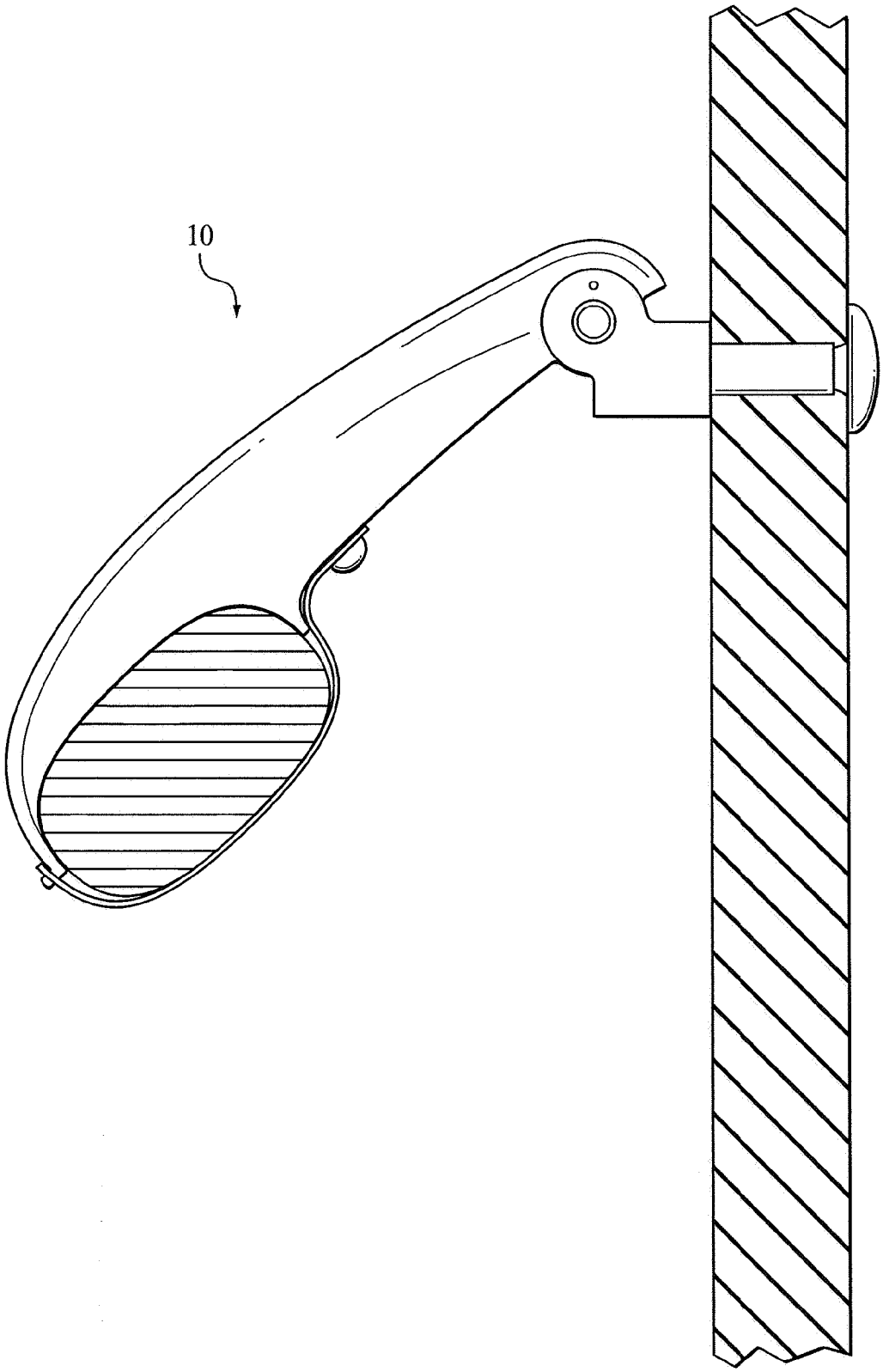
FIG. 3 is a side view of the hardware assembly of the present invention with the handle in the third position mounted to a cut-away casket.
Figure 4:
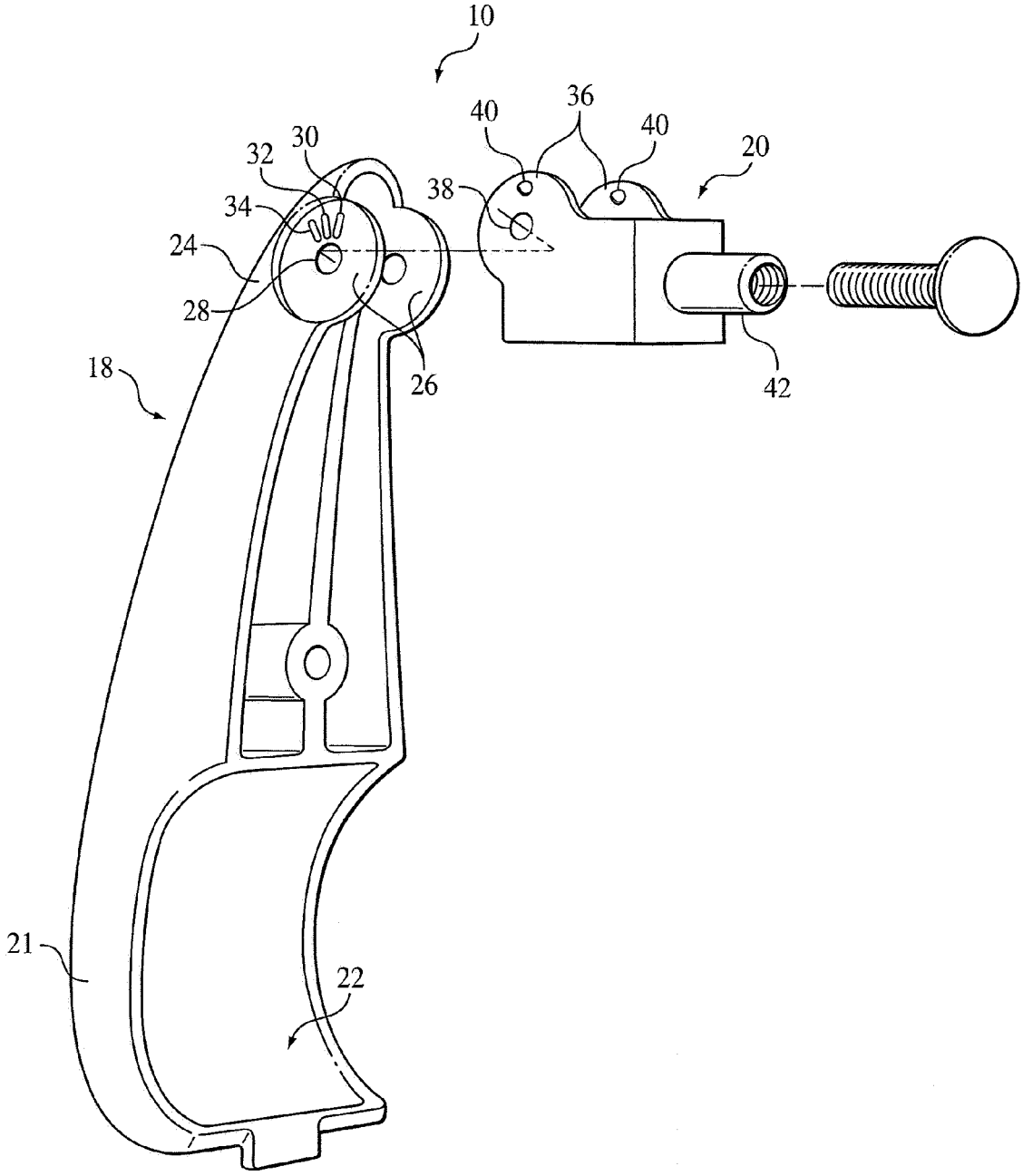
FIG. 4 is an exploded view of the hardware assembly of the present invention.
Figure 5:
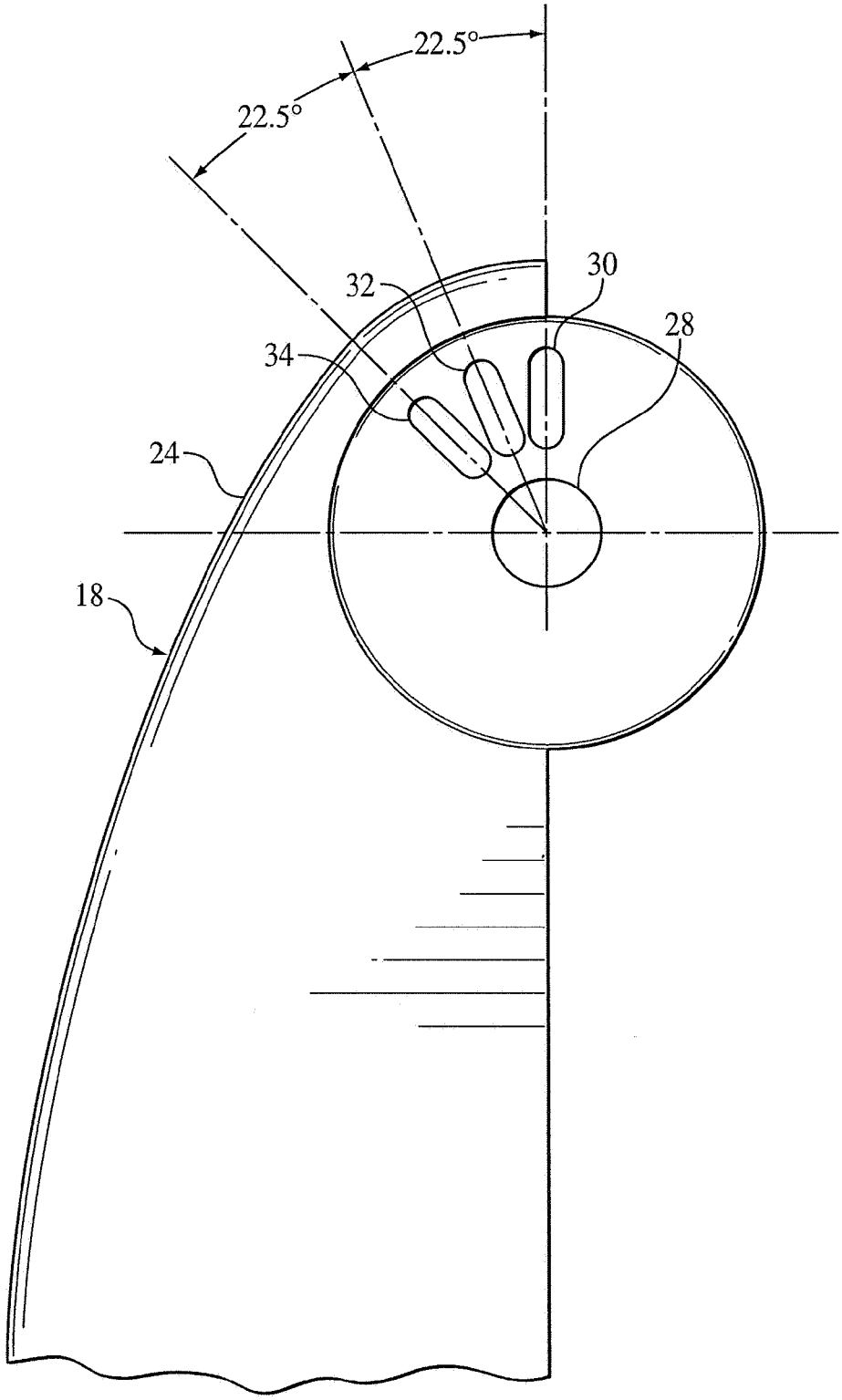
FIG. 5 is a close up view of a portion of the lifting arm of the present invention.

The handle hardware assembly of an exemplary embodiment of the present invention is generally shown at 10 (FIGS. 1-5) mounted to a casket 12 having sidewalls 14. The hardware assembly attaches a handle 16 to sidewall 14. Although only one hardware assembly is shown and described, one skilled in the art would know that each casket may have a plurality of handles and a plurality of hardware assemblies supporting one or more handles on each sidewall. The hardware assembly 10 comprises a lifting arm 18 and clevis 20. Lifting arm 18 (FIG. 4) includes a first distal end 21 having a contoured portion 22 which generally matches the contour of handle 16. Handle 16 may be secured to arm 18 by a backplate and screw (FIG. 1) in a known manner. The second end 24 of arm 18 includes a pair of pivot arms 26 having a central pivot hole 28 and three radially spaced depressions 30, 32, 34 surrounding pivot hole 28 on the outside faces of the pivot arms 26. The middle depression 32 (FIG. 5) is spaced 22.5° apart from each of the other two depressions 30 and 34.

Clevis 20 is generally U-shaped having a pair of pivot flanges 36 which straddle the lifting arm pivot arms 26. Each clevis pivot flange 36 has a central pivot hole 38 and a single protrusion 40 on the inside face of the pivot flange 36. Clevis 20 is connected to lifting arm 18 by a rivet 39 through the corresponding pivot holes.

Each protrusion 40 is engageable in a selected one of a corresponding depression 30, 32, 34 to provide three stops or positions providing a fixed position type arrangement. In the first position (FIG. 1), protrusion 40 is engaged in first depression 30. In this position, the handle 16 is in a retracted position and is nearly flush against sidewall 14.

A second position (FIG. 2) is a midpoint position at 22.5° of rotation from the first position with protrusion 40 engaged in second depression 32.

The third position (FIG. 3) is an extended, casket carrying position with protrusion 40 engaged in third depression 34.

Clevis 20 further includes a female internally threaded attachment portion 42 which is insertable into a mounting hole of sidewall 14. Attachment portion 42 is disposed on a connecting portion between the clevis pivot flanges 36, extending opposite thereto.

A low profile fastener or bolt 44 is insertable from inside casket 12 into attachment portion 42 such that the sharp end of the bolt is between clevis pivot flanges 36 and the bolt head is flush with the inside face of the casket sidewall 14. Thus, the sharp end of the bolt 44 does not protrude into the casket interior potentially injuring a funeral director's hand or puncturing the body.

Although the present invention has been described in detail for the purpose of illustration, it is to be understood that such detail is solely for that purpose and that variations such as different types, number or positions of position stops can be made therein by those in the art without departing from the spirit and scope of the invention.

What is claimed is:

1. A casket comprising:

a casket sidewall;

a casket handle; and a casket handle hardware assembly for mounting the casket handle to the casket sidewall comprising;

a lifting arm having a first end connectable to the casket handle and a second end having a plurality of position stops formed thereon; and a mounting base for pivotally mounting the lifting arm to the casket sidewall, the mounting base mountable to the casket sidewall and having at least one position formed thereon and stop engageable with the plurality of lifting arm position stops to provide a selected number of fixed positions for the casket handle relative to the casket sidewall.

2. The casket of claim 1, wherein the selected number of fixed positions is at least three.

3. The casket of claim 1, further comprising a fastener which is mountable from the interior of the casket through the sidewall and into the mounting base.

4. A casket handle hardware assembly for a casket having a sidewall comprising:

a lifting arm having a first end connectable to a casket handle and a second end having a pair of pivot arms; each pivot arm having a plurality of radially spaced depressions; and a clevis mountable to the sidewall having a pair of pivot flanges, each clevis pivot flange having a protrusion which is engageable with the depressions of a corresponding pivot arm to provide a selected number of fixed positions for the handle relative to the sidewall.

5. The casket handle hardware assembly of claim 4, further comprising a bolt which is mountable from the interior of the casket through the sidewall and into the clevis.

6. A casket comprising:

a sidewall;

a casket handle; and a casket handle hardware assembly for mounting the casket handle to the sidewall comprising:

a lifting arm having a first end connectable to the casket handle and a second end having a pair of pivot arms; each pivot arm having a plurality of radially spaced depressions; and a clevis mountable to the sidewall having a pair of pivot flanges, each clevis pivot flange having a protrusion which is engageable with the depressions of a corresponding pivot arm to provide a selected number of fixed positions for the handle relative to the sidewall.

7. The casket of claim 6, further comprising a bolt which is mountable from the interior of the casket through the sidewall and into the clevis.

* * * * *

UNITED STATES PATENT AND TRADEMARK OFFICE

CERTIFICATE OF CORRECTION

PATENT NO. : 7,308,742 B2
APPLICATION NO. : 11/536184
DATED : December 18, 2007
INVENTOR(S) : Schulz It is certified that error appears in the above-identified patent and that said Letters Patent is hereby corrected as shown below:

Col. 2 line 66 Claim 1, after “position” insert --stop--.

Col. 2 line 67 Claim 1, delete “stop”.

Signed and Sealed this

Twentieth Day of May, 2008

JON W. DUDAS
*Director of the United States Patent and Trademark Office*